US005195835A

United States Patent [19]

Collins

[11] Patent Number: 5,195,835

[45] Date of Patent: Mar. 23, 1993

[54] CASSETTE

[75] Inventor: Ian P. Collins, Houghton, United Kingdom

[73] Assignee: Esselte Dymo N.V., Niklaas, Belgium

[21] Appl. No.: 795,326

[22] Filed: Nov. 20, 1991

[30] Foreign Application Priority Data

Nov. 20, 1990 [GB] United Kingdom ..... 9025242

[51] Int. Cl.[5] ..... B41J 35/28; B41J 35/04

[52] U.S. Cl. ..... 400/207; 400/248

[58] Field of Search ..... 400/207, 208, 247, 248.1, 400/248, 613; 156/384, 386, 387

[56] References Cited

U.S. PATENT DOCUMENTS 4,272,202 6/1981 Schroeder et al. ..... 400/208
4,650,351 3/1987 Engle et al. ..... 400/207
4,676,681 6/1987 Kikuchi et al. ..... 400/247
4,927,278 5/1990 Kuzuya et al. ..... 400/207

FOREIGN PATENT DOCUMENTS 0158963 10/1985 European Pat. Off. .
3005260 8/1981 Fed. Rep. of Germany .
6015188 1/1985 Japan .
0144067 6/1988 Japan ..... 400/208

*Primary Examiner*—Edgar S. Burr
*Assistant Examiner*—Anthony H. Nguyen
*Attorney, Agent, or Firm*—Pennie & Edmonds

[57] ABSTRACT

A cassette comprises a base part and a closure member (202). The base part and closure member each have mating guide members which, when they mate, form and enclosed guide for tape housed in the cassette. In this way, construction of the cassette is simplified.

6 Claims, 1 Drawing Sheet

FIG.1.
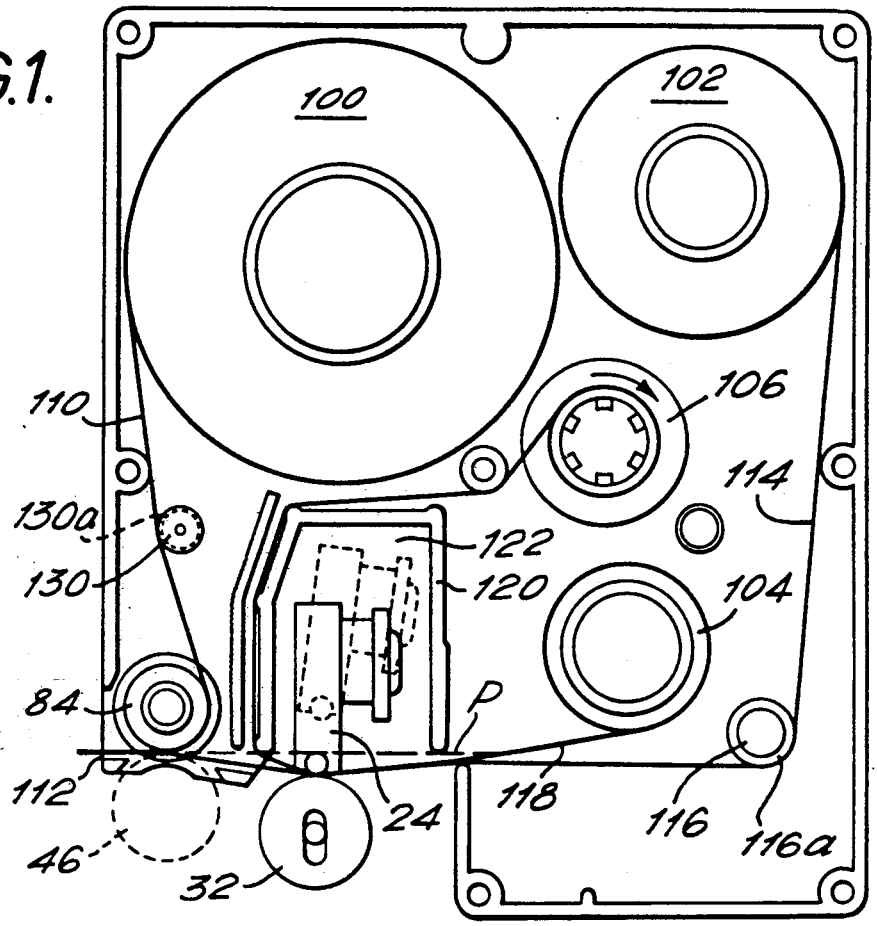
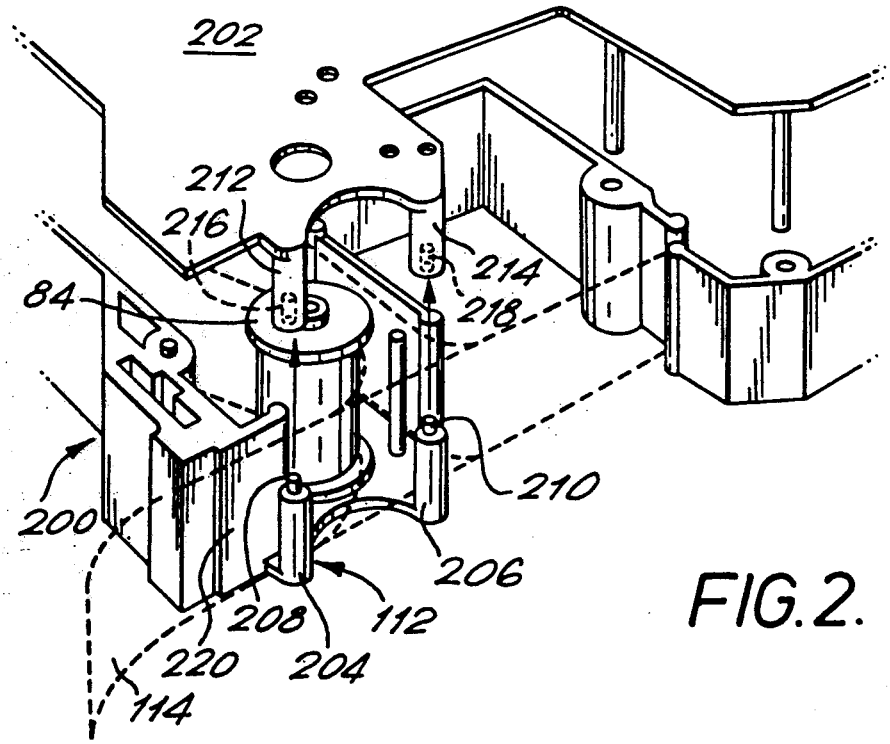
FIG.2.

CASSETTE

This invention relates to a cassette, particularly but not exclusively a cassette for a thermal printer.

A thermal printer is one in which printing is carried out using an electrically activated print head with a plurality of individually energisable heating elements which, when brought into contact with an ink ribbon and heated, transfer the ink from the ribbon to an image receiving tape in accordance with the data to be printed. A cassette carrying the ink ribbon and the image receiving tape is loaded into the printer so that the ink ribbon and image receiving tape are guided in overlap through a printing zone. During printing, the image receiving tape is held against the ink ribbon by a platen bearing against the print head and holding the ink ribbon and image receiving tape under pressure therebetween.

A thermal printer of this type is described in European Patent Application Publication No. 0322919 in the name of Brother. A cassette for the printer is described in European Patent Application Publication No. 0322918.

That cassette has a housing which includes an ink ribbon, an image receiving tape and an adhesive backing tape. The cassette has a base part supporting spools for the ink ribbon, image receiving tape and adhesive backing tape and a closure member which is secured to the base part when the spools have been properly located during assembly. In assembly of the cassette the free end of the image receiving tape has to be threaded through an enclosed guide of the base portion near the outlet of the cassette. This makes assembly of the cassette fiddly and awkward and thus increases manufacturing costs.

An object of the invention is thus to simplify assembly of the cassette.

According to the present invention there is provided a cassette having a base part for supporting a spool of tape and comprising a first guide member defining with a wall region of the base part a slot for receiving tape from the spool; and a closure member comprising a second guide member which is arranged to mate with said first guide member to form an enclosed guide for the tape.

With this arrangement, the assembly of the cassette is simplified since it is not necessary to thread the tape through an enclosed guide but merely to slot it into the gap between the wall region of the base part and the first guide member, which holds the tape in place. The second guide member then mates with the first guide member to enclose the ribbon.

The cassette can also include a spool of an adhesive backing tape to be secured to the tape when it has been printed. In that case, the base part may have a third guide member arranged to mate with a fourth guide member on the closure member to define a second enclosed guide as an outlet of the cassette through which the printed tape and the adhesive backing tape are passed in overlap.

For a better understanding of the present invention, and to show how the same may be carried into effect, reference will now be made, by way of example, to the accompanying drawings, in which:

FIG. 1 is a plan view of a cassette for insertion into the thermal printer; and

FIG. 2 is a perspective view of part of the cassette housing.

FIG. 1 shows a plan view of a cassette with its closure member removed. The cassette comprises a spool 100 of an adhesive backing tape 110, a spool 102 which supplies a transparent image receiving tape 114, an ink ribbon supply spool 104, an ink ribbon rewind spool 106 and an output roller 84. The backing tape 110 extends from the backing tape spool 100 around the output roller 84 and from there to the outlet 112 of the cassette. The cassette is intended to be inserted into a thermal printer having a print head 24 and a platen 32 defining a print zone. The printer also has a drive roller 46 which cooperates with the output roller 84 to drive tape out of the cassette. When the cassette is inserted into a thermal printer, the image receiving tape 114 extends from its spool 102, around a guide 116, between the print head 24 and the platen 32 of the printer, between the output roller 84 and drive roller 46 and thereto the outlet of the cassette.

The path of the backing tape is such that a guide 130 is needed. The backing tape has an adhesive layer on its outer surface with a releasable backing layer secured thereto and an adhesive layer on its inner side (facing the guide 130). To avoid adhesion of the tape to the guide 130, and consequent disruption to operation, the guide 130 has a plurality of circumferential notches or grooves **130*a*** to reduce the area of the guide in contact with the tape.

The ink ribbon 118 runs from the supply spool 104, through a printing zone 122 between the print head 24 and the platen 32, round a guide 120 in the cassette which defines a recess delineating the printing zone 122 and finally to the ink ribbon to take up spool 106. The recess in the cassette accommodates the thermal print head and is large enough to accommodate movement of the print head into and out of the operative position.

In use an image is printed onto the surface of the image receiving tape facing the ink ribbon as a mirror image so that when viewed towards the other surface of the image receiving tape it is viewed the correct way round.

The ink receiving tape is made of transparent polyester about 50 μm thick. The span of the ink ribbon 118 between the supply spool 104 and the output roller 108, and the resilience of the image receiving tape 114 is such that, when the print head 24 returns to its inoperative position, the tape 114 returns under its own resilience to adopt a path (indicated by a broken line marked P in FIG. 1) out of contact with both the print head 24 and the platen 32. As the ink ribbon 118 lies behind image ink receiving tape, it is carried with the image receiving tape 114 to adopt the path P. In this way the ink ribbon is maintained out of contact with the print head and platen when the print head is in the inoperative position without the need for a biasing mechanism in the cassette to accomplish this objective.

FIG. 2 illustrates part of the cassette housing in a perspective view. The housing comprises a base part 200 and a closure member or lid 202. The base part 200 has two lower guide posts 204,206 each carrying a respective peg 208,210. The lid of the cassette 202 has two cooperating upper guide posts 212,214 which have central passages 216,218 for receiving respectively the pegs 208,210. The posts 206,214 define an enclosed guide through which the image receiving tape is passed. The posts 204,212 define a second guide through which image receiving tape and the adhesive backing layer are guided in overlap. On assembly of the cassette, the lower guide posts 204,206 define with wall regions 220,221 of the cassette housing slots to hold the ends of the tapes in place at the outlet 112. The lid 202 is then put in place so that the upper and lower guide posts mate to form enclosed guides for the tape.

In this way assembly of the cassette is simplified considerably.

I claim:

1. A cassette comprising:

a base part comprising a wall defining an area for containing a first spool of tape, a base for supporting the first spool of tape within said wall, a first guide member spaced apart from said wall externally thereof and of a height less than the height of said wall and defining with said wall a slot for receiving tape from the first spool; and a closure member comprising a surface for closing said first spool containing area and adapted to be supported by said wall and a second guide member extending from said surface and having a height such that the combined height of said first and second guide members is substantially equal to the height of said wall, said first and second guide members having mating elements to properly position said guide members with respect to each other so as to together to define with said wall a first enclosed guide for the tape from the first spool; and means for securing the closure member to the base part.

2. A cassette according to claim 1, further comprising a second spool of adhesive backing tape to be secured to the tape from the first spool after printing, wherein the first guide member defines an outlet of the cassette through which the tape from the first spool and the adhesive backing tape from the second spool are passed in overlap.

3. A cassette according to claim 1, wherein said guide members each comprise a guide post and said mating elements include a central passage in one of said posts and a peg extending from the other of said posts, said peg being received in said central passage.

4. A cassette according to claim 2, wherein said guide members each comprise a guide post and said mating elements include a central passage in one of said posts and a peg extending from the other of said posts, said peg being received in said central passage.

5. A cassette according to claim 1, wherein the base part further comprises a third guide member and the closure member further comprises a fourth guide member arranged to mate with the third guide member to define a second enclosed guide for the tape from the first spool.

6. A cassette according to claim 2, wherein the base part further comprises a third guide member and the closure member further comprises a fourth guide member arranged to mate with the third guide member to define a second enclosed guide for the tape from the first spool.

* * * * *